US005456547A

United States Patent [19]

Thomas et al.

[11] Patent Number: 5,456,547

[45] **Date of Patent: * Oct. 10, 1995**

[54] CUTTING OF REPETITIVE DEPRESSIONS IN ROADWAY SURFACE

[76] Inventors: Glen E. Thomas; Amona D. Thomas, both of P.O. Box 1083, Moore Haven, Fla. 33471

[ * ] Notice: The portion of the term of this patent subsequent to Feb. 21, 2012 has been disclaimed.

[21] Appl. No.: 179,672

[22] Filed: Jan. 11, 1994

[51] Int. Cl.[6] ..... E01C 23/09

[52] U.S. Cl. ..... 404/72; 404/90; 404/93; 404/94

[58] Field of Search ..... 404/72, 90, 93, 404/94; 299/38, 39

[56] References Cited

U.S. PATENT DOCUMENTS 5,391,017 2/1995 Thomas et al. ..... 404/90

*Primary Examiner*—Ramon S. Britts
*Assistant Examiner*—Pamela A. O'Connor

[57] ABSTRACT

A machine and method of use to form Sonic Noise Alert Pattern (SNAP) type depressions in the surface of an asphalt road in a series to line the edge or center of a road. The machine installs a plurality of depressions in a group during a single cutting procedure. A repetition of these cutting procedures results in the desired series being formed. The machine has a single rotary type milling head with spaced sets of bits which will engage the surface of the road. Only where the spaced sets contact the surface will the cutting action be performed. From a stationary position an initial plunge cut brings the rotary cutting head in contact with the surface. Then a lateral movement of the rotary cutting head results in elongating and forming the desired sized depressions. Then the rotary cutting head is raised, the machine is advanced and the prior steps are repeated in repetition until the desired number of depressions have been formed.

14 Claims, 8 Drawing Sheets

24
102
20
28
100
110
112
108
168
116
126
114
122
124
104
118
106
120
30
128
130
26
32
22

24
202
20
28
226
222
200
210
212
232
228
224
214
220
230
204
216
206
218
30
26
32
22

24
20
302
28
300
308
362
364
324
310
338
322
328
360
22
304
314
312
26
336
316
30
318
306
32

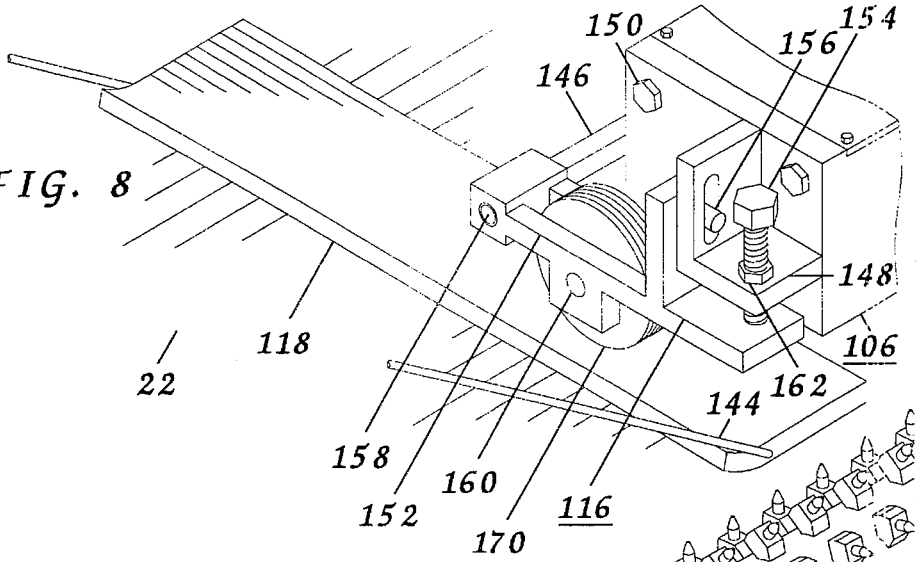
FIG. 8
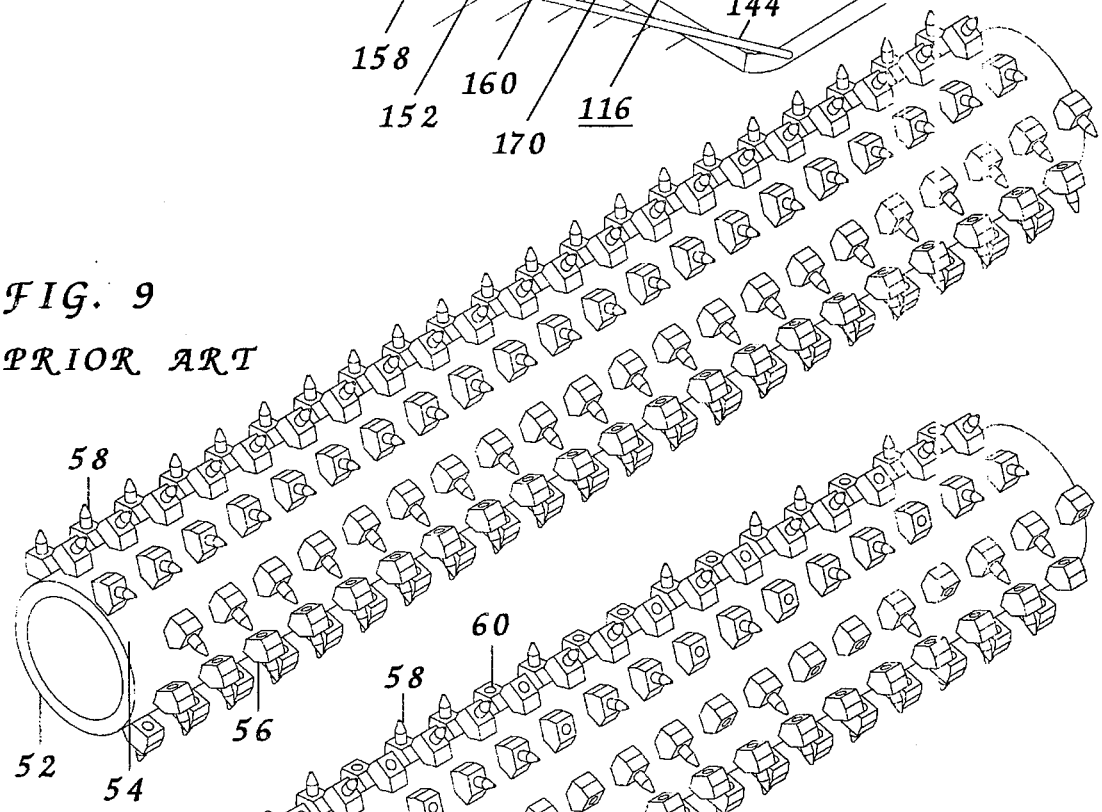
FIG. 9
PRIOR ART
FIG. 10

CUTTING OF REPETITIVE DEPRESSIONS IN ROADWAY SURFACE

BACKGROUND

Sonic noise alert patterns, (SNAP's), are a series of depressions cut into the surface of asphalt roads. They are placed in lines along borders which generally are not crossed by a vehicle at a cruising speed without the specific guidance of the operator of the vehicle. The principal location of these series are along the edges of the road between the normal driving lane and the shoulder of the road. The shoulder is commonly comprised of loose earth with a vegetation cover such as grass. Scattered along this area are various objects which are hazardous if contact is made with a vehicle travelling at a normal cruising speed. The primary purpose of these SNAP's is to alert drivers that they have left the normal driving lane and therefore that a dangerous condition is being approached. The rumbling of the vehicle as they cross these depressions cause vibration to the vehicle and results in a audible sound being generated by the vehicle. Transportation management personnel have found SNAP's to be extremely effective in reducing vehicular accidents on roads with a proper installation of SNAP type depressions.

A common method of installing SNAP type depressions is with a machine equipped with a single rotary milling head. The machine is paused, a single plunge cut is made, then the machine is advanced, paused, and the procedure is repeated. This method results in the number of cutting procedures required to install the SNAP's being equal to the number of depressions in the series.

A second method has a multiheaded cutting tool, with the rotary cutting heads in a row, making a single plunge cut to form a first group of depressions. Then the multiheaded cutting tool is advanced by a distance to allow a plunge cut to form a second group of depressions between each of the adjacent prior cuts and one cut beyond the prior group. Then the machine is advance beyond the group formed by the combination of these two sets, and the procedure starts anew and is performed in repetition to form the desired series. This method requires the use of a plurality of cutting drums equal to the number of depressions within each of the two groups of depressions. The group formed by the two cutting actions, due to the precision placement of the tool, results in an overall spacing that tends to be less accurate than desired. The machine, due to the plurality of cutting heads, is significantly more expensive than a single headed cutting machine.

Fore the foregoing reasons, there is a need for a simple single headed cutting tool capable of installing a plurality of depressions in a single cutting procedure.

SUMMARY

The present invention is directed to satisfying the need for a machine capable of installing a plurality of depressions in a single cutting procedure utilizing a single rotary type cutting head. A machine having the features of the present invention comprises a self propelled vehicle which the operator would guide along the predetermined path of placement of the series of SNAP type depressions. A vehicle having a single rotary cutting head, a mechanism for raising and lowering the rotary cutting head and a mechanism for moving the rotary cutting head laterally to form a group of depressions is disclosed. The vehicle would be paused, the rotary cutting head would be lowered to engage the surface of the asphalt road to begin the cutting action, the rotary cutting head would be moved laterally to complete the group of cuts, then the rotary cutting head would be raised to disengage the surface of the asphalt road. This cutting procedure would be performed in repetition to install the desired series of depressions.

BRIEF DESCRIPTION OF THE DRAWINGS

These and other features, aspects, and advantages of the present invention will become apparent to those skilled in the art from the following description, appended claims, and accompanying drawings where:

FIG. 8 is a perspective view of a cutaway section of the cutting head assembly with attached support member and resting on a plate as illustrated in FIG. 1.

FIG. 9 is a perspective view of a prior art drum with attached spaced blocks with a complete installation of bits.

FIG. 10 is a perspective view of the drum illustrated in FIG. 9 with bits properly installed in eight spaced cutting groups.

FIG. 13 is a plan view showing a housing, stationary and elevated above an asphalt surface, awaiting the beginning of a cutting procedure.

FIG. 14 is a plan view showing the housing after lowering to cause contact with the surface of the asphalt road by the bits.

FIG. 15 is a plan view showing the housing half way through the lateral movement procedure.

FIG. 16 is a plan view showing the housing completely through the lateral movement procedure.

FIG. 17 is a plan view showing the housing after being raised to cause disengagement with the surface of the asphalt road by the bits, and the completion of the cutting procedure to form a group of depressions.

DESCRIPTION

Definitions

Figure 1:
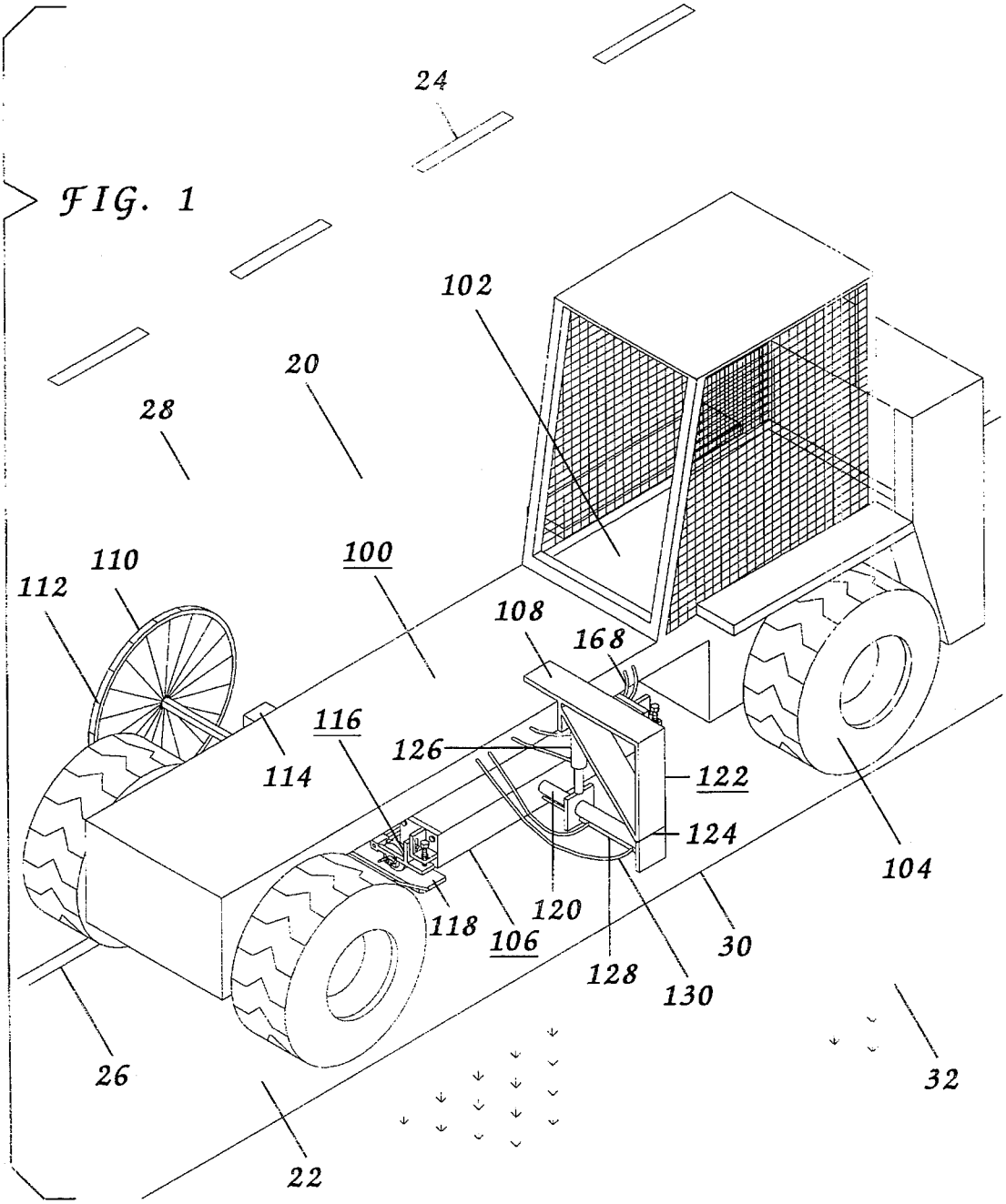
FIG. 1 is a perspective view of an embodiment of the invention showing a self propelled vehicle, with a cutting assembly attached, properly positioned on the side of an asphalt road awaiting the beginning of a cutting procedure.

Advance means refers to the movement of the machine, in a guided manner, along a desired course matching a predetermined desired placement plan.

Alignment refers to the positioning of the machine to provide for a predetermined course or path of the depressions to be installed in the surface of an asphalt road. It relates to the placement of the series of depressions in a relative row, the placement of the series of depressions relative to an edge of the road and the placement of one group relative to each adjacent group of depressions. The alignment of a series of depressions has the depressions placed in a row with a side of one depression relatively parallel to the nearer side of the adjacent depression, and the end nearer the edge of the road relatively parallel to the edge of the asphalt road.

Base refers to the bottom of each of the cut depressions. Each base is bordered by two opposing ends and two opposing sides. Each base has a relatively level central area formed by the lateral motion of the rotary cutting head. Each base tapers upward from the level central area to terminate with the two opposing ends. Each base terminates with a relatively square face on the two opposing sides.

Block refers to the adapters which are attached, most commonly by welding, to the drum. The blocks permit the installation of bits on the cutting head drum.

Bit refers to the individual cutting teeth members which are selectively install within the blocks which are attached to the drum. The bits perform the actual cutting of the asphalt road surface.

Continuous pattern refers to a series of depressions having a uniform and unbroken array of depressions as its primary design. It being understood that within a continuous pattern uncut sections will be present for predetermined conditions such as intersections and bridges.

Cutting head adjustment refers to aligning the rotary cutting head within the cutting head assembly for uniform exposure of the cutting teeth from the bottom of the cutting head assembly.

Cutting head drum refers to the unit which accepts the selective installation of bits. The cutting head drum with the bits installed form the rotary cutting head.

Cutting machine refers to the entire machine used to perform a cutting procedure.

Depression and indentation are used in an interchangeable manner, they refer to a cut made in the surface of an asphalt road which forms a unit with a base lower than the surrounding uncut asphalt surface.

Depth of a depression refers to the distance from the plane of the prevailing uncut surface of the surrounding asphalt to the plane formed by the deepest part of the resulting depression.

Drum refers to the unit which accepts the selective installation of blocks which are capable of having bits installed therein.

Elevation refers to the raising and lowering of the drum so as to bring the bits into contact with the asphalt surface of the road and take the bits out of contact with the asphalt surface of the road.

Ends refer to the transitional edges of each depression which taper in from the surrounding uncut asphalt surface to the base of the depression. Each end is relatively parallel to the edge of the pavement surface and are relatively in line with the path of the series of depressions.

Group of depressions refer to the plurality of depressions formed by a single cutting procedure of the cutting machine. It being understood that a repetition of these cutting procedures result in the forming of a series of depressions.

Indentation and depression are used in an interchangeable manner, they refer to a cut made in the surface of an asphalt road which forms a unit with a base lower than the surrounding uncut asphalt surface.

Lateral movement refers to the movement of the rotary cutting head while in contact with the surface of the asphalt road and cutting is being performed. The movement is relatively perpendicular to the edge of the asphalt road and relatively parallel with the road surface. It being understood that the direction of this lateral movement is therefore relatively perpendicular with the alignment of the depressions in each group and relatively perpendicular with the forward direction of travel of the cutting machine.

Length of a depression refers to a measurement of the length of the level central area of a depression. It being understood that this measurement is relatively parallel to the movement of the drum during the lateral movement and relatively perpendicular to the forward motion of the machine.

Leveling means refers to the adjustment of the leveling members of the cutting head assembly, being skids or wheels, to raise or lower the cutting head assembly to provide a relatively uniform seating of the cutting head assembly, with the proper depth of the resulting depressions, to the surface of the asphalt road.

Measurement means refers to the ability to accurately move the machine from a first stationary position, being the location of a cutting procedure, to a second stationary position, being the next location of a cutting procedure. This measurement will be equal to the distance from the beginning of a first group of depressions to the corresponding point on a second group of depressions. It being understood that uncut sections occur at certain locations within a series such as intersections. It further being understood that placement within a series having a skip pattern would result in movement of the machine to leave uncut sections within the series.

Pausing refers to stopping the forward motion of the machine to permit the steps involved in lowering the rotary cutting head, laterally moving the rotary cutting head and raising the rotary cutting head which result in the forming of a group of depressions.

Plate refers to opposing members installed on the vehicle to move with the vehicle and constantly remain between the support members and the asphalt under treatment. Plates are extremely effective when freshly laid asphalt is under treatment.

Power take off refers to the transfer of power from the self propelled vehicle to another piece of equipment. Such power is utilized to power the rotation of the rotary cutting head, the elevation of the rotary cutting head and the lateral movement of the rotary cutting head. While hydraulic power is envisioned as the most practical supply means, belt, chain and rotation transferred by a shaft are practical alternatives.

Rotary cutting head refers to the unit with causes the cutting to the surface of the asphalt road under treatment. It is comprised of the drum, properly attached blocks and properly installed bits to form cutting groups. It being understood that the rotary cutting head is continually rotating during a cutting operation.

Series of depressions refers to a plurality of depressions, either continual or in a skip pattern, that extend either parallel along an edge of an asphalt road or parallel to the center, or dividing line, of the road.

Sides refer to the edges of each depression which are formed by the lateral movement of the rotary cutting head. Each side is relatively perpendicular to the edge of the pavement surface and the path of the series of depressions.

Skip pattern refers to the selective placement of depressions within a series of depressions so as to leave predetermined uncut sections within the series. An example has a series having a plurality of groups each having eight depressions, with each set of adjacent groups separated by a distance equal to the placement of four depressions.

Spaced cutting groups refer to the selective placement of the bits on the drum to provide for a group of cuts to be made when the rotary cutting head comes in contact with the asphalt road surface. It being understood that each group has a width equal to the relative width of the resulting depression and a spacing between each set of adjacent spaced cutting groups relatively equal to the spacing between adjacent depressions.

Spacing refer to a measurement of the distance of uncut asphalt between each adjacent set of depressions. This distance is measured from the side of one depression to the closer side of the adjacent depression.

Width of a depression refers to the distance from one side of each depression to the opposing side of that depression. It being understood that this measurement of distance is relatively parallel to the forward motion of the machine and relatively perpendicular to the movement of the cutting head assembly during the lateral movement.

Overview

Referring now to the drawings where like reference numerals refer to like parts throughout the various views. FIG. 1 is perspective view of a first embodiment of the invention showing a vehicle 100. Vehicle 100, having a plurality of wheels 104, shown paused on asphalt road surface 20, awaiting the beginning of a cutting procedure. Vehicle 100 is properly aligned with the desired placement of a series of depression along pavement shoulder 22. Pavement shoulder 22 is a part of asphalt road surface 20. Driving lane 28, bordered by dividing line 24 and a side strip 26, occasionally has a friction course of asphalt and therefore during those occasions is slightly elevated from pavement shoulder 22. Dividing line 24 and side strip 26 are markings of paint, most commonly applied by a spraying process, on asphalt road surface 20. Beyond the area of asphalt road surface 20, bordered by an edge of pavement 30, lies a shoulder 32, most commonly of earth.

A measuring wheel 110, having markings 112 attached, is secured to vehicle 100 utilizing attachment 114. It being noted that measuring wheel 110 is in contact with asphalt road surface 20 and turns in a corresponding manner when vehicle 100 is advanced. Operator compartment 102 is provided for the operator of vehicle 100 during operation. Markings 112 allow the operator to mentally record a first paused locations position, then advance the vehicle a predetermine desired distance, and pause the vehicle at the second desired location, with a relative degree of accuracy. Attached, utilizing attachment 108, to vehicle 100 is a support 122 having a hinged joint 124. Support 122 is capable of raising and lowering support ram 120, utilizing a lift hydraulic unit 126. Support ram 120 has attached thereto a cutting head assembly 106. Therefore support 122 acts to elevate cutting head assembly 106 relative to asphalt road surface 20. Support 122 is capable of causing lateral movement of cutting head assembly 106 by utilizing a lateral hydraulic unit 128. Attached to, and a part of, cutting head assembly 106, is a support member 116, shown resting on a plate 118. Plate 118 is attached to vehicle 100 and moves in a corresponding manner with vehicle 100 during advance of vehicle 100.

Vehicle 100 has the capability to transfer hydraulic power utilizing various hydraulic fluid lines including drive hydraulic line 168 and various other hydraulic lines 130. Drive hydraulic line 168 provides power to cause rotation of the cutting head drum, contained within cutting head assembly 106, which will perform the actual cutting of the pavement. Hydraulic lines 130 provide power to cause the above described elevation movement and lateral movement to cutting head assembly 106.

Figure 2:
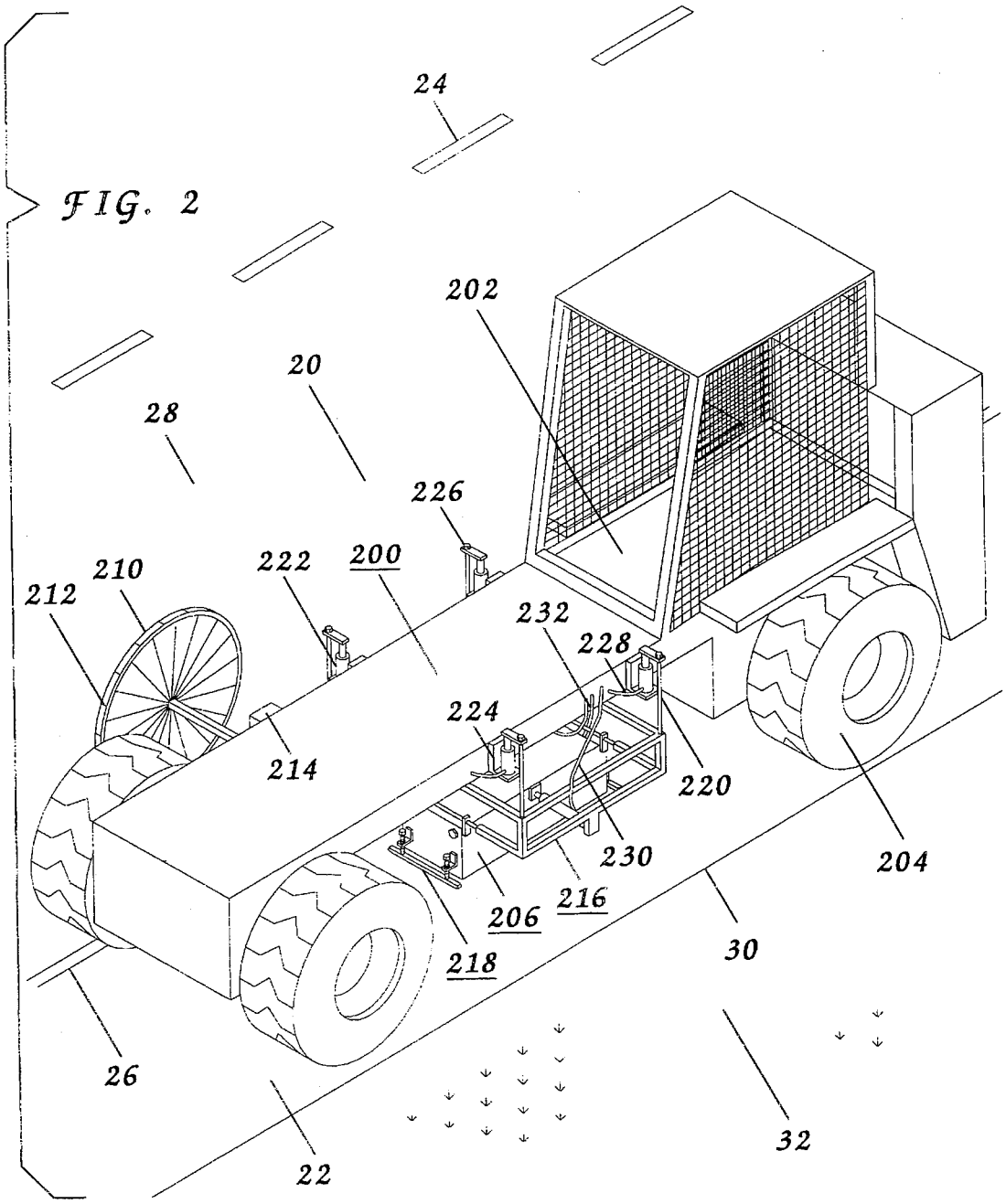
FIG. 2 is a perspective view of a second embodiment of the invention showing a self propelled vehicle, with a cutting assembly attached, properly positioned on the side of an asphalt road awaiting the beginning of a cutting procedure.

FIG. 2 is perspective view of a second embodiment of the invention showing a vehicle 200. Vehicle 200, having a plurality of wheels 204, shown paused on asphalt road surface 20, awaiting the beginning of a cutting procedure. Vehicle 200 is properly aligned with the desired placement of a series of depression along pavement shoulder 22. Pavement shoulder 22 is a part of asphalt road surface 20. Driving lane 28, bordered by dividing line 24 and a side strip 26, occasionally has a friction course of asphalt and therefore on those occasions is slightly elevated from pavement shoulder 22. Dividing line 24 and side strip 26 are markings of paint, most commonly applied by a spraying process, on asphalt road surface 20. Beyond the area of asphalt road surface 20, bordered by an edge of pavement 30, lies a shoulder 32, most commonly of earth.

A measuring wheel 210, having markings 212 attached, is secured to vehicle 200 utilizing attachment 214. It being noted that measuring wheel 210 is in contact with asphalt road surface 20 and turns in a corresponding manner when vehicle 200 is advanced. Operator compartment 202 is provided for the operator of vehicle 200 during operation. Markings 212 allow the operator to mentally record a first paused locations position, then advance the vehicle a predetermine desired distance, and pause the vehicle at the second desired location, with a relative degree of accuracy. Attached, utilizing attachments 224, elevation connection members 220, elevation hydraulic units 222 and securing members 226, to vehicle 200 is an elevation frame 216. Elevation frame 216 has attached thereto a cutting head assembly 206 having opposing support members 218. Cutting head assembly 206 contains a rotary cutting drum. Elevation frame 216 is capable of raising and lowering cutting head assembly 206, relative to asphalt road surface 20 utilizing elevation hydraulic units 222.

Vehicle 200 has the capability to transfer hydraulic power utilizing various hydraulic fluid lines including drive hydraulic line 232, elevation hydraulic lines 228 and lateral hydraulic lines 230. Drive hydraulic line 232 provides power to cause rotation of the cutting head drum, contained within cutting head assembly 206, which will perform the actual cutting of the pavement. Elevation hydraulic lines 230 provide power to cause the above described elevation movement and lateral hydraulic lines 230 provide power to cause lateral movement to cutting head assembly 206.

Figure 3:
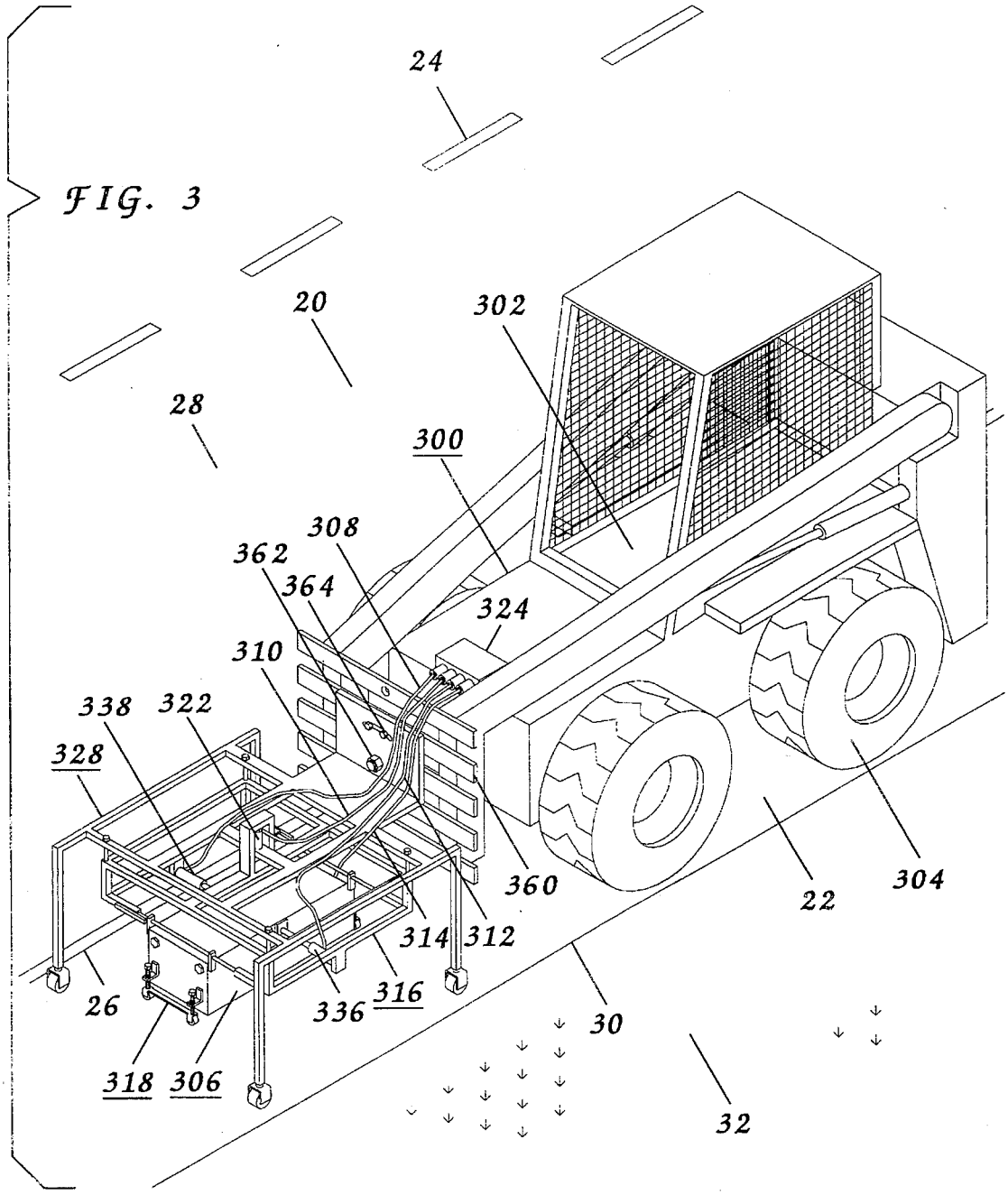
FIG. 3 is a perspective view of a third embodiment of the invention showing a skid steer loader, with a cutting assembly attached, properly positioned on the side of an asphalt road awaiting the beginning of a cutting procedure.

FIG. 3 is perspective view of a third embodiment of the invention showing a vehicle 300 being a skid steer loader. Vehicle 300, having a plurality of wheels 304, shown paused on asphalt road surface 20, awaiting the beginning of a cutting procedure. Vehicle 300 is properly aligned with the desired placement of a series of depression along pavement shoulder 22. Pavement shoulder 22 is a part of asphalt road surface 20. Driving lane 28, bordered by dividing line 24 and a side strip 26, occasionally has a friction course of asphalt and therefore during those occasions is slightly elevated from pavement shoulder 22. Dividing line 24 and side strip 26 are markings of paint, most commonly applied by a spraying process, on asphalt road surface 20. Beyond the area of asphalt road surface 20, bordered by an edge of pavement 30, lies a shoulder 32, most commonly of earth.

An operator compartment 302 is provided for the operator of vehicle 300 during operation. Securing members 360 are illustrated attached to vehicle 300. Attached to securing members 360, utilizing securing bolt 362 and secondary securing bolt 364, is a support frame 328. Attached to support frame 328 is an elevation frame 316 capable of being elevated relative to support frame 328 utilizing a lift hydraulic unit 322. Attached to elevation frame 316 is a cutting head assembly 306 which contains a rotary cutting drum. Cutting head assembly 306 has attached thereto opposing support members 318. A first hydraulic unit 336 is capable of causing a selective first lateral movement of cutting head assembly 306. A second hydraulic unit 338 is capable of causing a selective second lateral movement of cutting head assembly 306.

Vehicle 300 has the capability to transfer hydraulic power from a hydraulic coupling box 324 to various hydraulic lines. A first hydraulic line 308 provides hydraulic power to second hydraulic unit 338. A second hydraulic line 310 provides hydraulic power to lift hydraulic unit 322. A third hydraulic line 312 provides hydraulic power to first hydraulic unit 336. A fourth hydraulic line 314 provides hydraulic power to power the rotary cutting drum contained within cutting head assembly 306.

Detailed Description of the Elements

Figure 4:
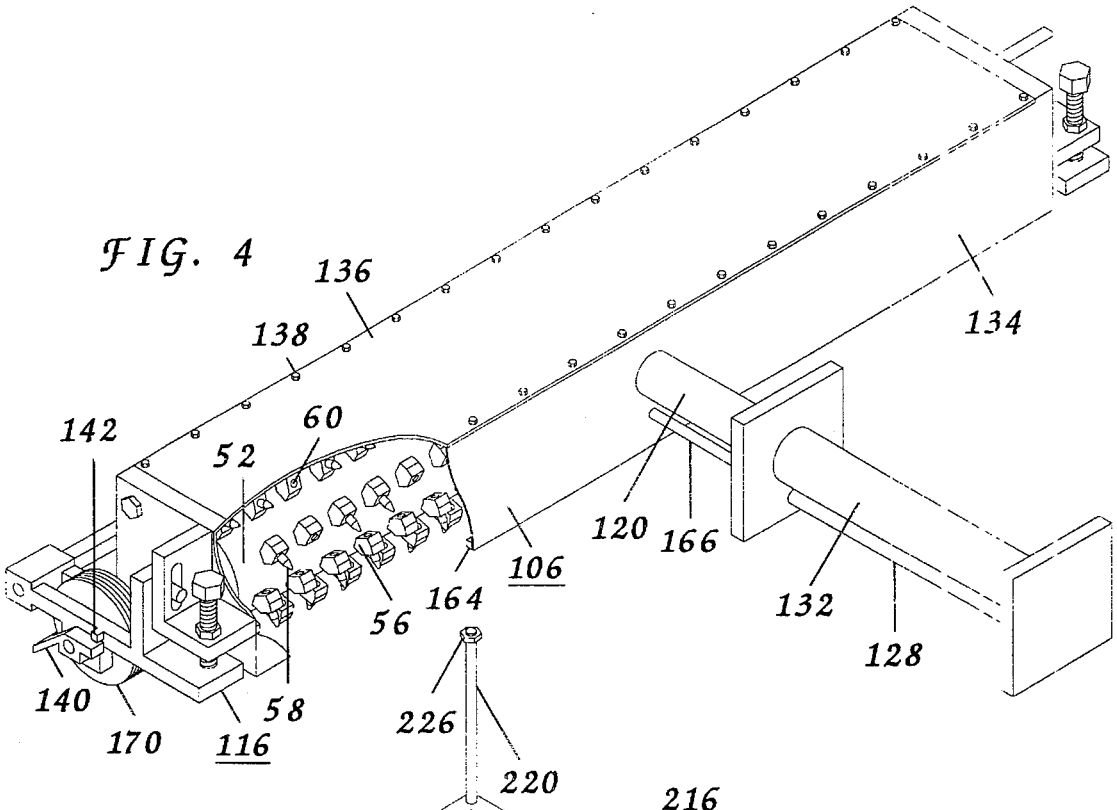
FIG. 4 is an enlarged perspective view of the detached cutting head assembly with attached ram and hydraulic unit as illustrated in FIG. 1.

FIG. 4 is an enlarged perspective view of a cutting head assembly 106 as illustrated in FIG. 1 and described above, with a section of the housing 134 and cover 136 cutaway to reveal the mechanism contained therein. A ram casing 132 having an enclosed support ram 120 is shown. It being understood that attachment to the vehicle is disclosed above. A lateral hydraulic unit 128 having a hydraulic shaft 166 causes lateral movement of support ram 120 relative to ram casing 132. Attached to support ram 120 and hydraulic shaft 166 is a cutting head assembly 106 having a housing 134 and opposing attached support members 116. Housing 134 contains a drum 52, of a tubular design, having attached thereto various blocks 56 attached by a conventional method such as welding. Shown selectively inserted in various blocks 56 are bits 58. Attention is directed to a plurality of empty blocks 60 which do not have bits installed. Housing 134 has a cover 136 attached utilizing bolts 138 which permit access to the mechanism contained within housing 134. Housing 134 is strengthened to ensure structural integrity by various reinforcement members 164. Support member 116, having a support wheel 170 provides support for cutting head assembly 106 during the lateral movement of the cutting procedure. Path clearer 140 moves along the asphalt surface during the lateral movement of the cutting procedure to ensure proper contact of support wheel 170 with the asphalt surface under treatment. Path clearer 140 has a limited range of motion by the inclusion of stop member 142.

Figure 5:
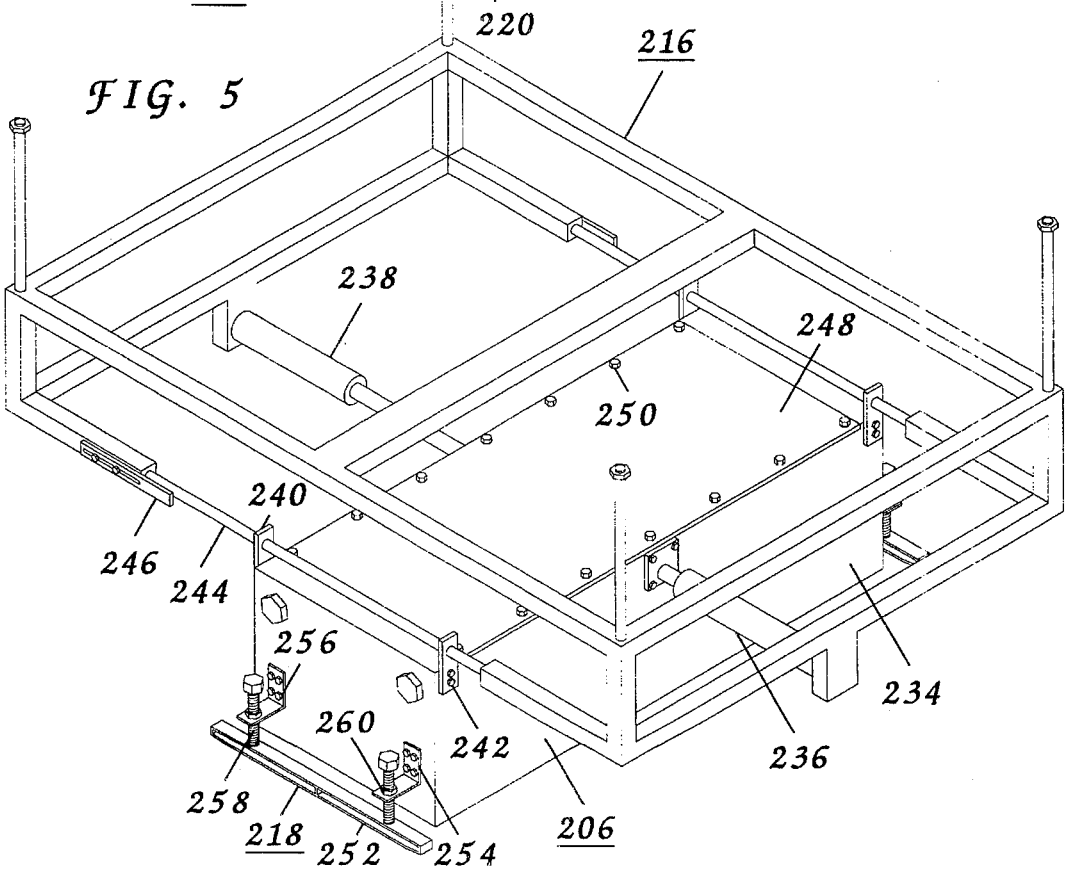
FIG. 5 is an enlarged perspective view of the detached cutting head assembly with attached elevation frame as illustrated in FIG. 2.

FIG. 5 is an enlarged perspective view of a cutting head assembly 206 as illustrated in FIG. 2 and described above. An elevation frame 216 is formed of a suitable framing material such as steel bars. Extending from elevation frame 216 are a plurality of elevation connection members 220 each having a securing member 226. As disclosed for FIG. 2 above, attachment of elevation frame 216 to a suitable vehicle is facilitated utilizing elevation connection members 220. Elevation connection members 220 are utilized to elevate cutting head assembly 206 during operation. Cutting head assembly 206, having a housing 234, has contained therein a rotary cutting drum which is accessible by removing cover 248 secured by bolts 250. Incorporated as a part of elevation frame 216 are two opposing lateral travel rods 244 which penetrate lateral guides 240. Lateral guides 240 are securely attached to cutting head assembly 206 utilizing bolts 242. Attached to cutting head assembly 206 are opposing support members 218 utilizing opposing attachments 254 secured by various bolts 256. Skids 252 are secured utilizing height adjustment members 258 and securing members 260 to attachments 254. It being understood that skids 252 will be in contact with the asphalt road surface intermittently during operation and during these occasions will partially support cutting head assembly 206. Skids 252 are adjustable to support cutting head assembly 206 a desired height by the selective adjustment of height adjustment members 258 and secured in the desired location by engaging securing members 260. Cutting head assembly 206 is mounted to slide relative to elevation frame 216 utilizing lateral guides 240. During operation, and after lowering, a first lateral hydraulic unit 236 will cause cutting head assembly 206 to be moved along lateral travel rods 244 to a desired location or until contact with opposing movement stops 246. Following the raising operation, a second lateral hydraulic unit 238 will cause cutting head assembly 206 to be returned along lateral travel rods 244 to the first operating location. It being understood that hydraulic power is provided as described for FIG. 2 above.

Figure 6:
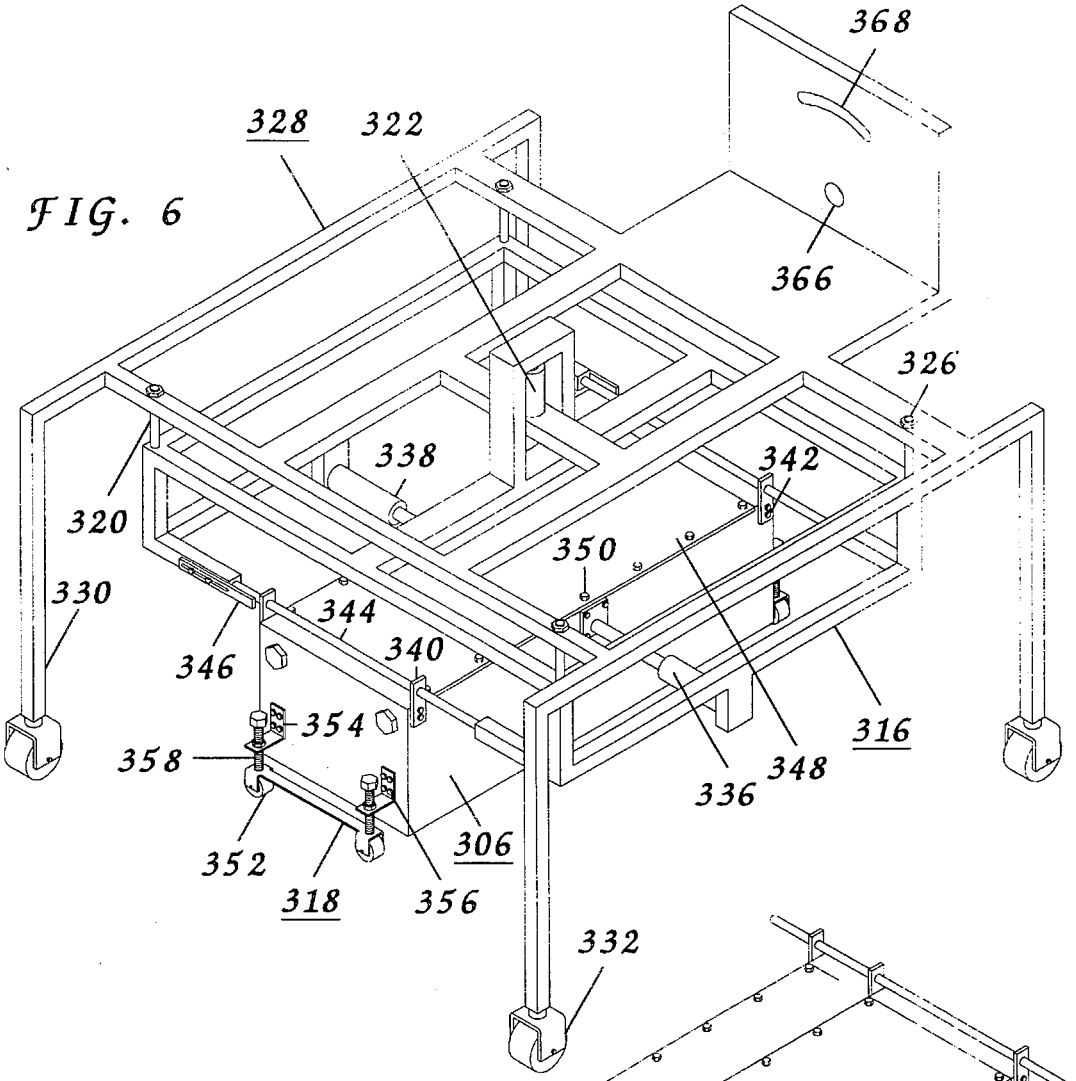
FIG. 6 is an enlarged perspective view of the detached cutting head assembly with attached elevation frame and support frame as illustrated in FIG. 3.

FIG. 6 is an enlarged perspective view of support frame 328, elevation frame 316 and cutting head assembly 306 as illustrated in FIG. 3 and described above. Support frame 328 is attached to a vehicle utilizing securing hole 366 and secondary securing slot 368. Securement is facilitated by utilizing securing bolt 362 and secondary securing bolt 364 shown in FIG. 3 and described above. It being understood that support frame 328 will be capable of slight rocking along secondary securing slot 368 to afford adjustment for uneven contour of the asphalt road surface under treatment. Support frame 328 has attached a plurality of frame legs 330 each having a wheel assembly 332. It being understood that support frame 328 will be in constant contact with the asphalt surface under treatment during the cutting procedure. Attached to support frame 328 is an elevation frame 316 utilizing a plurality of elevation connection members 320 and corresponding securing members 326. It being understood that elevation frame is capable of vertical movement relative to support frame 328 by engagement of lift hydraulic unit 322. Elevation frame 316 has incorporated in its design opposing lateral travel rods 344. A cutting head assembly 306 is attached to elevation frame 316 utilizing a plurality of lateral guides 340. Cutting head assembly 306 has a cover 348 secured using bolts 350, which permits access to the rotary cutting drum contained therein. Each lateral guide is attached to cutting head assembly 306 by bolts 342. Cutting head assembly 306 has attached thereto opposing support members 318, having support wheels 352, which will support cutting head assembly during the lateral movement of the cutting procedure. Support members 318 are attached to cutting head assembly 306 by attachments 354 utilizing bolts 356. Support member 318 is positioned relative to cutting head assembly 306 by the selective adjustment of height adjustment members 358. A movement stop 346 is provided to prevent over cutting. Cutting head assembly is capable of first lateral movement, relative to elevation frame 316, by engaging a first hydraulic unit 336. Cutting head assembly is capable of a second lateral movement, relative to elevation frame 316, by engaging a second hydraulic unit 338. It being understood that hydraulic power is supplied as described above for FIG. 3.

Figure 7:
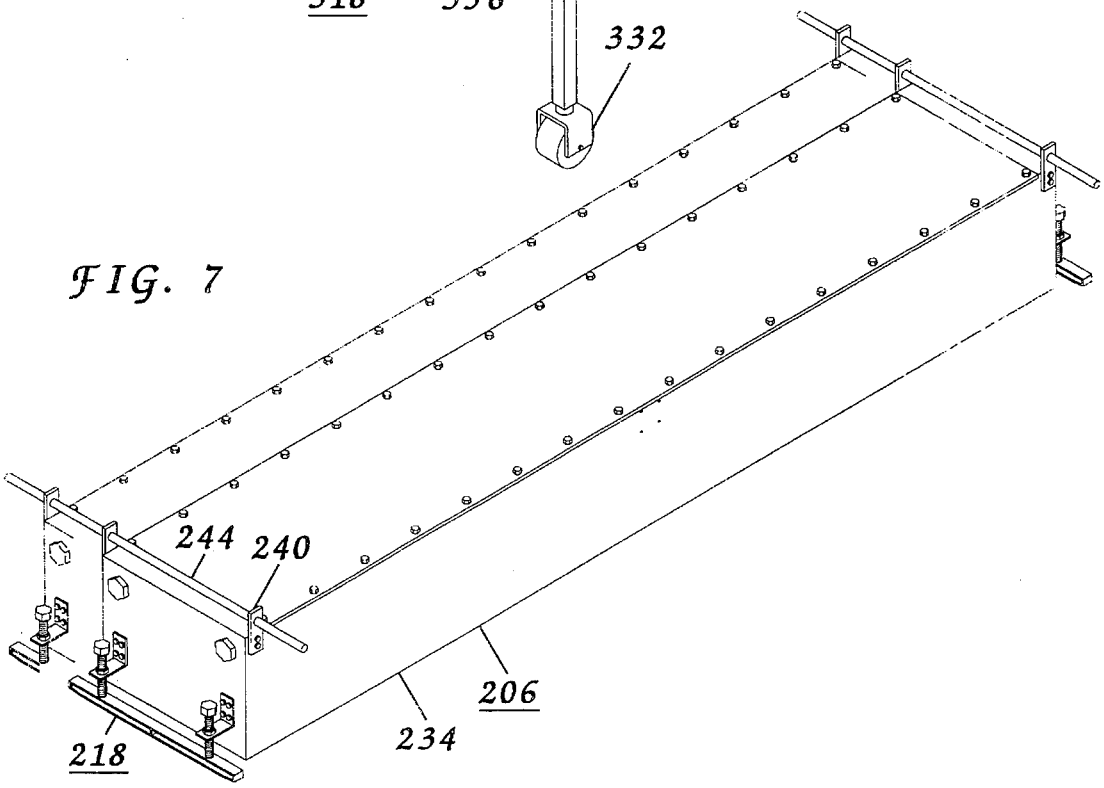
FIG. 7 is an enlarged perspective view of a cutting head assembly with phantom lines representing the lateral movement of the cutting head assembly during a typical cutting procedure.

FIG. 7 is a perspective view of a cutting head assembly 206 with phantom lines representing the position of cutting head assembly following the lateral movement step of the cutting procedure. A housing 234 is provided having attached thereto lateral guides 240 engaging lateral travel rods 244 as described above for FIG. 5. During the cutting procedure cutting head assembly 206 is lowered utilizing the elevation step to place support members 218 in contact with the asphalt surface under treatment and the lateral movement step is performed.

FIG. 8 is an enlarged perspective view of a cutaway section of a cutting head assembly 106 as illustrated in FIG. 1. Shown is a drum leveling member 150 which allows for the adjustment of the relative position of the cutting head drum contained within cutting head assembly 106 to ensure an even exposure of the cutting members. Attached to cutting head assembly 106 is a support member 116 having a first attachment member 146, a second attachment member 148 and a support plate 152. First attachment member 146 and second attachment member 148 are attached to cutting head assembly 106 by a conventional method such as welding or bolting. First attachment member 146 has incorporated into its design a pivotal shaft 158 which penetrates support plate 152. It being understood that support plate 152 is pivotal from this connection point. Penetrating second attachment member 148 is a height adjustment member 154 which allows selective elevation of support member 116 relative to cutting head assembly 106. Securing height adjustment member 154 at a desired position is a securing member 162. Support member 116 movement is restricted relative to second attachment member 148 by a movement stop 156. A support wheel 170 is attached to support member 116 by a wheel axle 160. It being understood that support wheel 170 will support cutting head assembly 106 during the first lateral movement step of the cutting procedure. Support wheel 170 is in contact with a plate 118 which is optionally used during the cutting procedure. Plate 118 is particularly effective when the cutting procedure is being performed on freshly laid asphalt where penetration by the machine is possible. Plate 118 is attached to the vehicle, as described above for FIG. 1, by attachment member 144. It being understood that plate 118 is dragged along pavement shoulder 22 relative to the vehicle during the advance step of the cutting procedure when cutting head assembly 106 is not in contact with plate 118.

FIG. 9 is a perspective view of a prior art drum 52 having an exterior of drum 54. Drum 52 is of a circular design and has attached a plurality of blocks 56 each capable of accepting a bit 58. It being understood that a properly installed bit 58 in a block 56 will remain securely installed and positioned. It being noted that in this prior art illustration all of the blocks 56 have installed therein a bit 58. Drum 52, as illustrated, is eight feet long and has a diameter, measured to exterior of drum 54, of twelve inches. The diameter, measured to the cutting tips of bits 58 is eighteen inches. Drum 52 is of the rotary type. As disclosed for FIG. 11, drum 52 has nine rows of spaced bits and a bit 58 will contact the asphalt road surface each one half of an inch along the length of drum 52 during rotation.

FIG. 10 is a perspective view of a drum 52, as illustrated in FIG. 9, with the selective installation of bits 58 within blocks 56 attached to exterior of drum 54. Attention is drawn to the plurality of empty blocks 60. It being understood that the selective installation of bits 58 provide for spaced cutting groups which will contact the asphalt surface under treatment. It being further understood that drum 52 will not perform a cutting operation along the sections that do not have bits 58 installed within blocks 56.

Figure 11:
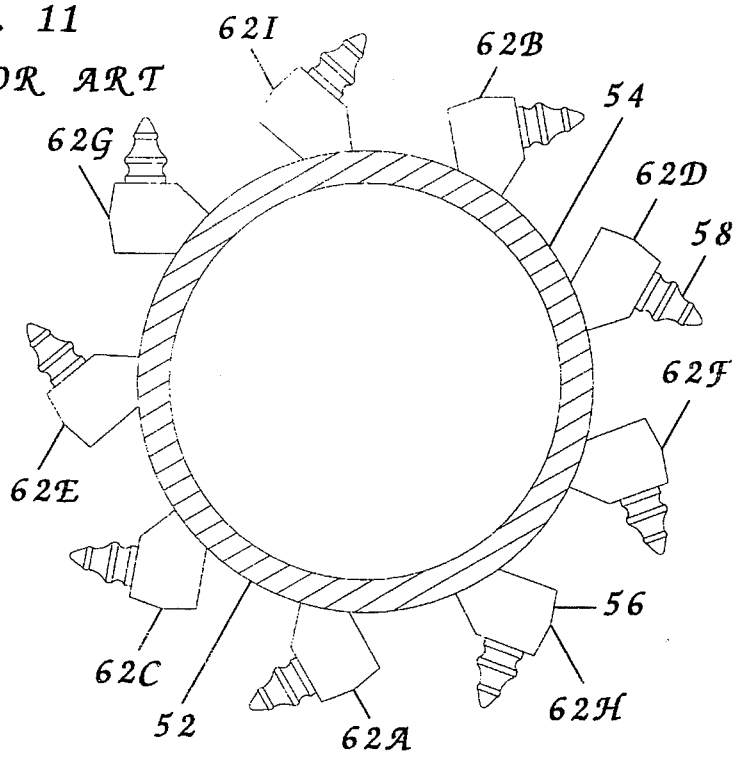
FIG. 11 PRIOR ART
FIG. 11 is a plan view illustrating an end of a drum with blocks attached having bits properly installed therein.

FIG. 11 is an enlarged plan view of a drum 52 as illustrated in FIG. 9 and FIG. 10. Drum 52 has an exterior of drum 54 which has attached thereto, utilizing a conventional method such as welding, various blocks 56. While many variations of placement of the blocks are possible, this illustration has nine rows of blocks 56. As described for FIG. 9 above the drum is eight feet long and has a diameter of twelve inches, with a diameter of eighteen inches to the tips of bits 58. Blocks 56 are attached along the length of drum 52 so as to have the spacing, during rotation, of one half of an inch between each block 56 measured center to center. The disclosed installation has blocks 56 distributed in such a manner as to permit the selective installation in spaced cutting groups that will not effect the balance of drum 52 during use. It being understood that during rotation of drum 52 each bit will have a circular path that will cross an imaginary line along the length of drum 52. The point of each bit 52 crossing this imaginary line will place it about one half of an inch from the adjacent bits 52. Therefore to form cutting groups having a width of cut of about seven inches and a spacing between adjacent groups of about five inches fourteen bits 58 are installed within blocks 56 then the next ten blocks 56 are left empty, in a repetitive pattern along the length of drum 52. For even distribution of blocks 56 and installed bits 58, an alternating pattern of attachment of blocks 56 to exterior of drum 54 is provided. The blocks 56 are attached in the following pattern, block 62A. block 62B, block 62C, block 62D, block 62E, block 62F, block 62G, block 62H and block 62I. Thus nine blocks 56 are attached covering about four and a half inches along the length of drum 52. This pattern is then repeated along the entire length of drum 52. Then depending upon the particular specifications of a series of depressions bits 58 are installed within the appropriate blocks 56 to provide the desired cutting groups. It being understood that a drum can be assembled by attaching blocks to provide the proper cutting groups without requiring extra blocks which will remain empty during operation for a specific set of specifications.

Figure 12:
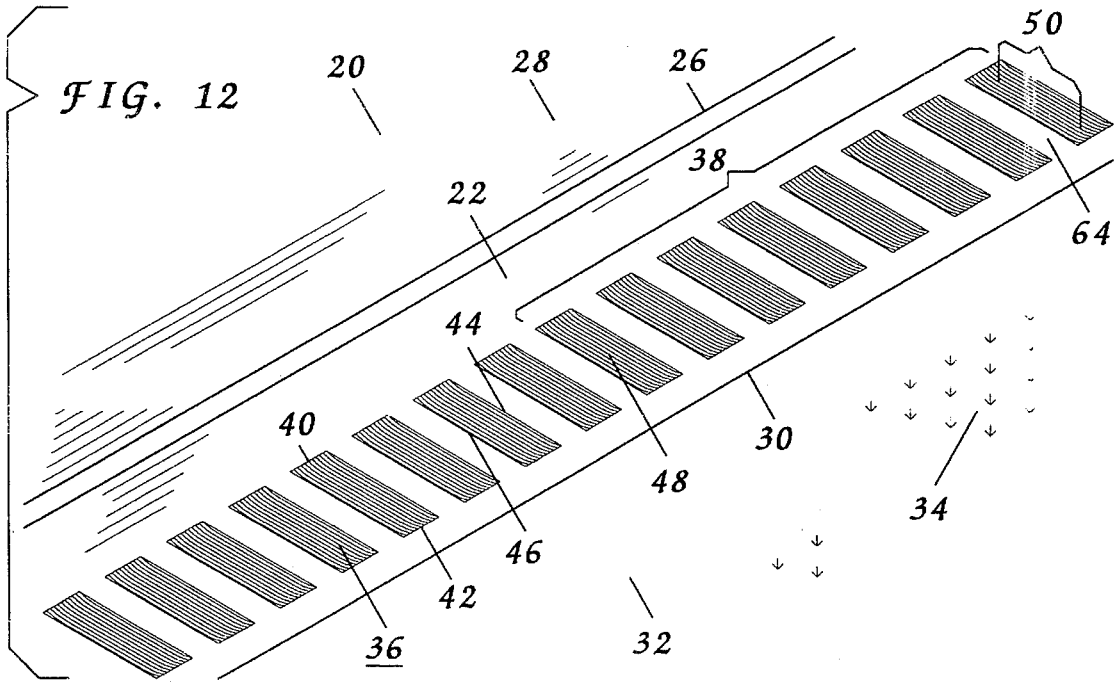
FIG. 12 is a perspective view of an asphalt road with a series of sixteen depressions, in two groups of eight depressions each, properly installed in the surface of the road.

FIG. 12 is a perspective view of an asphalt road surface 20 as illustrated in FIG. 1, FIG. 2 and FIG. 3 following the cutting procedure to install a series of depressions. Asphalt road surface 20, having a driving lane 28, a pavement shoulder 22, a side strip 26 and an edge of pavement 30. It being understood that side strip 26 acts to separate driving lane 28 from pavement shoulder 22. Shown properly installed are sixteen depressions 36 within two group of depressions 38 each having eight depressions 36. Beyond asphalt road surface 20 and adjacent to edge of pavement 30 is a shoulder 32 comprised of various materials but usually formed of earth with a covering of grass 34. It being understood that a vehicle entering into the area of shoulder 32 from driving lane 28 at a normal cruising speed is dangerous and therefore is to be avoided. As disclosed above each group of depressions 38 are formed by a series of steps which cause the installation of all of the depressions within the group to be installed in a single cutting procedure. Each depression 36 is comprised of a first end 40, an opposing second end 42, two opposing sides, being a first side 44 and a second side 46 and a base 48. Each depression further has a length of base 50 being the relatively level bottom of depression 36 formed by the lateral movement of the cutting head drum, as previously described. It being understood that first end 40 and second end 42 taper upward from length of base 50 to merge with the uncut surrounding asphalt road surface. It further being understood that the shade lines shown within each depression 36 are representative of the shape of each depression 36 and correspond with the lateral movement step of the cutting procedure. Each set of adjacent depressions 36 are separated by a spacing 64. The illustrated depressions 36 have a spacing, measured center to center of one foot, a spacing of uncut spacing of five inches, a width of seven inches, a length of base of sixteen inches with a overall length of approximately twenty two inches. It being noted that length of base 50 is relatively perpendicular to edge of pavement 30, and that each of the two ends, first end 40 and second end 42 are relatively parallel to edge of pavement 30.

FIG. 13 through FIG. 17 are plan view of a simplified rendition of a cutting drum assembly to illustrate several of the steps involved in the cutting procedure. It being understood that drum 402 is continually rotating in the indicated direction during the entire cutting procedure. It further being understood that drum 402 has a proper installation of bits 406 to form the desired cutting groups. Additionally it is understood that a vehicle is providing support and power to housing 408 as similarly disclosed previously.

Figure 13:
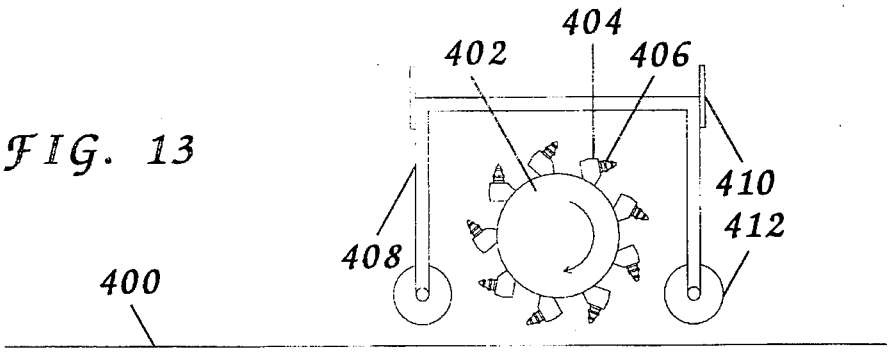
FIGS. 13 through 17 are a series of simplified plan views showing a cross section of a cutting head assembly and illustrating several of the steps involved in a typical cutting procedure.

FIG. 13 shows a housing 408 held aloft, utilizing elevation coupling 410, above asphalt surface 400 prior to the beginning of the cutting procedure. Drum 402 is rotating and has a proper installation of bits 406 within blocks 404. Support member 412 and bits 406 are not in contact with asphalt road surface 400.

Figure 14:
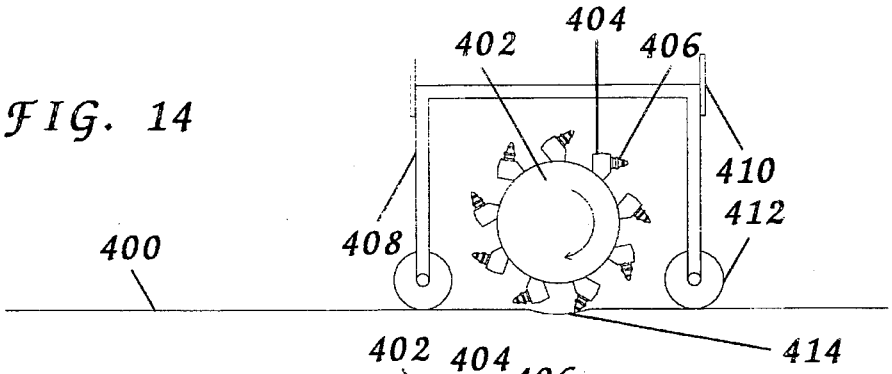

FIG. 14 shows housing 408 after the initial lowering step brings bits 406 into contact with asphalt road surface 400. Lowering is facilitated by lessening support on elevation coupling 410. Penetration is halted by contact of support member 412 with asphalt surface 400. Drum 402 continues to rotate while bits 406, held in spaced formation in blocks 404, form a plunge cut 414. It being understood that a group of plunge cuts are formed, one for each cutting group installed on drum 402.

Figure 15:
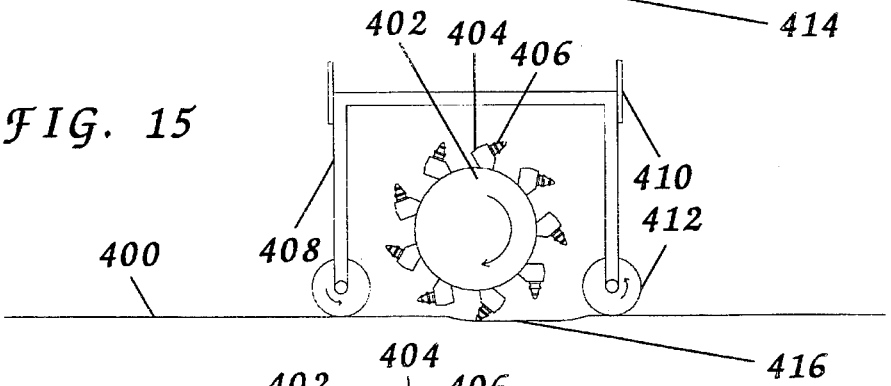

FIG. 15 shows housing 408 halfway through the lateral movement step, utilizing guidance from elevation coupling 410. Drum 402 continues to rotate with bits 406, installed within blocks 404, forming a transitional cut 416. Support members 412 are in continual contact with asphalt surface 400 and are rotating as indicated.

Figure 16:
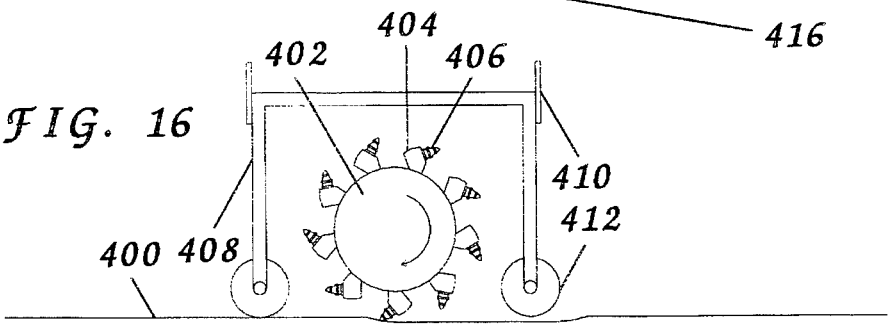

FIG. 16 shows housing 408 completely through the lateral movement step guided by elevation couplings 410. Drum 402 continues to rotate with bits 406, installed in blocks 404, continuing to be in contact with asphalt surface 400. It being understood that support members 412 are beyond the limits of the formed group of depressions and continues to be in contact with asphalt surface 400.

Figure 17:
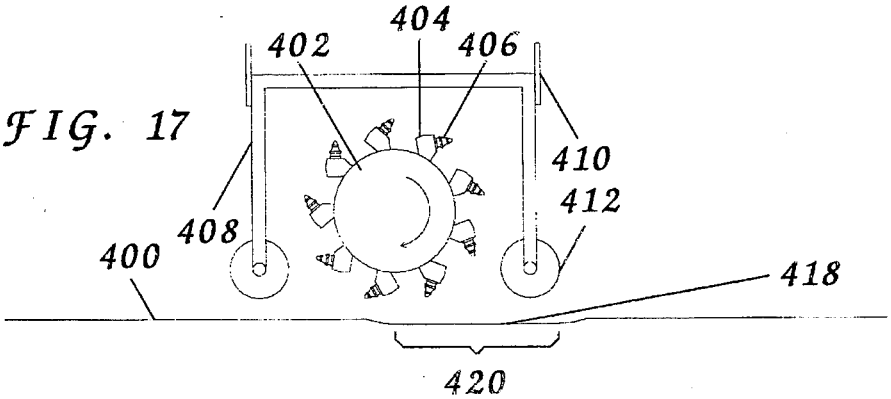

FIG. 17 shows housing 408 following the raising step which takes support members 412 and bits 406 out of contact with asphalt surface 400. Raising is facilitated by applying upward pressure on elevation couplings 410. Drum 402 continues to rotate with bits 406 installed in blocks 404. A depression cut 418 is show formed by the cutting procedure described above. Depression cut 418 has a length of base 420 which is formed by the level portion of the base. It being recognized that the above described steps form a group of spaced depressions based on the placement of the cutting groups of bits 406 installed on drum 402.

How the Invention is Used

Proper adjustments of the cutting head adjustment members and the leveling members are performed. The cutting head drum has been properly equipped with bits to form the desired spaced cutting groups to provide for the desired width and spacing of the resulting depressions. Adjustment has been made to the lateral movement stops to ensure that over cutting of the depressions does not occur. If relatively freshly laid asphalt is under treatment the optional inclusion of opposing drag plates is provided.

The machine is aligned and paused at a position corresponding with the beginning of a predetermined desired placement of a series of depressions. The rotary cutting head is rotating as it continually does during cutting operations. It being recognized that the preferred direction of rotation of the rotary cutting head has the bits entering the cut from the back of the cut and exiting from the front of the cut. This orientation provides negative pressure on the rotary cutting head though the lateral movement of the rotary cutting head during the cutting procedure. The opposing direction of rotation has the tendency to pull the rotary cutting head through the lateral movement step of the cutting procedure. The rotary cutting head is located at its beginning lateral position. Recognition of the measurement identified on the measuring wheel has been made by the operator to provide for even spacing of the resulting groups of depressions within the series of depressions. The rotary cutting head is lowered into contact with the surface of the asphalt road and cutting of a group of depressions begins. The cutting head assembly now is being supported by the support members which are in contact with the asphalt surface under treatment. The lateral movement of the rotary cutting head is begun once the cutting head assembly is fully seated with the surface of the asphalt. The rotary cutting head cuts the surface of the asphalt, to the predetermined depth throughout the stroke of the lateral movement. Once the lateral movement is complete the rotary cutting head is raised and cutting of a group of depressions is complete. The machine is then guided along the predetermined path to the next location of placement based on the measurement derived from the measuring wheel. The machine is then paused at this desired location. During this duration of time, from the raising of the rotary cutting head to the current placement, the lateral movement means has returned the rotary cutting head to its beginning lateral position. The steps are then repeated until the desired number and placement of cuts has been obtained. It being recognized that if the desired series contains sections of pavement which will remain uncut, placement of the machine is facilitated to pass these sections without performing the cutting procedure.

Advantages of the Invention

The previously described embodiments of the present invention have many advantages, including the use of a single rotating cutting drum to form a plurality of SNAP type depressions in a single cutting procedure. The placement of a plurality of depression in a single procedure results in a uniformity of the resulting cuts within that group of depressions. The relative drift that may occur during the placement of the vehicle is minimized by significantly reducing the number of placement operations within a series, compared to the number of placement operations utilizing a single headed cutting tool forming a single depression with each cutting procedure. The uniformity of the placement of depressions is enhanced compared to the current use multiheaded cutting tool which requires placement of a cutting procedure between depressions placed by a prior cutting procedure. Lower maintenance cost of the single headed cutting tool of the present invention is significant when compared to the multiheaded cutting tool in current use.

Specific Embodiments and Examples

FIG. 1 and FIG. 2 describe the attachment of the rotary cutting head, within a cutting head assembly, to a self propelled vehicle which, with the exception of the leveling member, is not in contact with the surface of the asphalt road. This embodiment requires that a dedicated vehicle be used for the invention, or at least that modifications be performed to the vehicle. FIG. 3 describes the detachable attachment to a self propelled vehicle, such as a skid steer loader, which provides versatility and allows for the use of the self propelled vehicle for other activities.

The rotating cutting drum of the cutting head assembly is typically from about four feet to twenty feet long with a diameter, measured to the cutting ends of the bits, from about six inches to about thirty-six inches. Preferably from about six feet to about twelve feet long with a diameter, measured to the cutting ends of the bits, from about twelve inches to about twenty-four inches. Most preferably about eight feet long with a diameter, measured to the cutting ends of the bits, of about eighteen inches.

The resulting cut depressions formed by the invention typically has a length of base from about twelve inches to about twenty inches, from about five inches to about nine inches wide, from about one quarter of an inch to about one inch deep and having a spacing between adjacent depressions from about three inches to about seven inches. Most preferably having a length of base of about sixteen inches, about seven inches wide, about one half an inch to about five eights of an inch deep with a spacing between adjacent cut depressions of about five inches. It being understood that the most preferred size and placement have been disclosed in the illustrations. The most preferred dimensions result in about 660 cutting procedures forming about 5280 depressions per mile for a continuous pattern installation. The typical dimensions result in about 3960 to about 7920 depressions per mile.

Alternatives and Closing

While a ram support and a simplified framing design have been disclosed, many such designs are possible. While the lateral movement rod is illustrated as round with holes penetrating the lateral movement guides, many shapes and configurations are possible including tracks.

While an embodiment illustrating the detachable attachment to the front of a self propelled vehicle has been disclosed, resulting in the pushing of the cutting head assembly, attachment to the rear of the self propelled vehicle is envisioned, resulting in the pulling of the cutting head assembly.

While machines that raise and lower, utilizing the elevation means, the entire cutting head assembly have been disclosed, the raising and lowering of the rotary cutting head within a stationary cutting head assembly is envisioned and disclosed.

While the preferred installation of SNAP type depression has a series of relatively identical depressions, with a relatively even spacing between adjacent depressions, variations in the size and spacing of the depressions within each group of depressions is envisioned and disclosed. As an example, the most preferred orientation of depressions has eight identical depressions with a width of seven inches each and a spacing of five inches between adjacent depressions. It would be possible to equip the rotary cutting head with spaced cutting groups to install eight depression with the first, third, fifth and seventh being six inches wide each and the second, fourth, sixth and eighth being eight inches wide each. Many such variations are possible, envisioned and disclosed.

While the optional plate is illustrated for the embodiment shown in FIG. 1, it is understood that installation on the other embodiments is disclosed. Similarly a measuring wheel is applicable to the embodiment shown in FIG. 3. While elevation of the cutting head drum is disclosed utilizing various mechanical apparatuses, elevation, both lowering and raising, utilizing the movement of the lateral motion is envisioned and disclosed. One such example provides a track having a downward sloped section, a level central section and a upward sloped section. The lateral motion would result in a back and forth cutting operation with advance of the machine while the cutting head drum was raised on one of the sloped sections of the track. Many such possibilities are envisioned and disclosed. While specific embodiments have been disclosed having certain embodiments of the various features, many possible working configurations are possible and disclosed.

While many specific structural details have been disclosed, it will be understood that it is capable of many modifications, and this application is intended to cover any variation, uses, or adaptations of the invention, following in general the principles of the invention and including such departures from the present disclosure as to come with the knowledge of customary practice in the art, and as may be applied to the essential features hereinbefore set forth and falling within the scope of the invention or the limits of the appended claims.

We claim:

1. A machine for cutting a group of depressions, in a cutting procedure, to form a series of depressions in an asphalt road surface, from a repetition of the cutting procedures, the resulting depressions each having a predetermined width, the width measured along the alignment of depressions, a predetermined length, the length measured relatively perpendicular to the edge of the asphalt surface, a predetermined depth, the depth measured from the prevailing surface of the asphalt road to the deepest point of the resulting depression, the resulting depressions having a predetermined spacing between adjacent depressions, the machine comprising;

a) a self propelled vehicle, the vehicle comprising power take off means for supplying power to other equipment, directional control means to guide the vehicle along a desired course, the vehicle having a forward direction of travel;

b) a cutting head assembly comprising a rotary cutting head, the rotary cutting head having a predetermined length, the rotary cutting head movably attached to the self propelled vehicle and relatively aligned with the forward direction of travel of the vehicle, the rotary cutting head having a plurality of cutting members in a predetermined spaced pattern forming a cutting diameter, the cutting members forming a plurality of similarly dimensioned cutting groups, the cutting groups having perimeters, the perimeters being spaced one from another, the cutting groups each having a length equal to the desired width of the resulting depression, the spacing of the perimeters of each adjacent set of cutting sets being relatively equal to the desired spacing between the resulting depressions, the rotary cutting head deriving power from the power take off means and continually rotating during the cutting operation of the machine;

c) advance means for moving the machine along the forward direction of travel;

d) alignment means for aligning the machine to a relative desired location;

e) pausing means for pausing the movement of the machine at the desired location;

f) elevation adjustment means for adjustment of the altitude of the cutting head assembly to the surface of the asphalt road, the elevation adjustment means comprising the lowering of the cutting head assembly to cause engagement of the surface of the asphalt road by the rotary cutting head, and the raising of the cutting head assembly to cause disengagement from the surface of the asphalt road by the rotary cutting head;

g) lateral movement means for moving the cutting head assembly relatively perpendicular to the forward direction of travel and relatively parallel to the surface of the asphalt road, following the pausing of the advance of the machine, while the rotary cutting head continually engages the surface of the asphalt road, following engagement of the surface of the asphalt road by the cutting head assembly utilizing the elevation adjustment means and prior to the disengagement of the surface of the asphalt road by the cutting head assembly utilizing the elevation adjustment means, the lateral movement means being powered by the power take off means of the self propelled vehicle;

whereby a group of depressions are cut in one operation, the machine is advanced, paused and the next group in the series of cuts are made, in a steady repetition of such cuts which are used to form the desired pattern based on the particular specification of the project.

2. The machine defined in claim 1 wherein the power take off means comprise hydraulic power transfer.

3. The machine defined in claim 1 wherein the predetermined width of the resulting depression is approximately seven inches, the predetermined length of the base of the resulting depression is approximately sixteen inches, the predetermined depth of the resulting depression is approximately one half an inch and the predetermined spacing between adjacent depressions of the resulting depressions is approximately five inches.

4. The machine defined in claim 1 wherein the plurality of cutting members of the rotary cutting head comprise eight cutting sets.

5. The machine defined in claim 1 wherein the cutting head assembly is mounted to a location relatively centered along the length of the self propelled vehicle.

6. The machine defined in claim 1 wherein the cutting head assembly is secured to a frontal area of the self propelled vehicle.

7. The method of forming a series of SNAP type depression in an asphalt road surface in a repetition of cutting procedures, each cutting procedure forming a group of depressions, each depression within the group of depressions having a predetermined size, the series of SNAP type depressions forming a desired placement of resulting depressions in an asphalt road surface, the desired placement being relatively parallel to an edge of the asphalt road, the method comprising the following steps;

a) providing a cutting machine having a rotary cutting head, the rotary cutting head having a plurality of spaced cutting groups, the rotary cutting head attached to the cutting machine relatively in line with the forward movement of the cutting machine, the rotary cutting head continually rotating during the cutting procedure;

b) aligning the cutting machine relative to the desired alignment of the resulting depressions;

c) pausing the cutting machine at a desired location of placement of one of the groups of the depressions;

d) lowering the rotary cutting head relative to the cutting machine to engage the asphalt road surface and commence cutting the asphalt road surface;

e) moving the rotary cutting head relatively perpendicular to the edge of the asphalt road and relatively parallel to the asphalt road surface, the movement of the rotary cutting head causing a cutting of the surface of the asphalt road surface to form a group of depressions;

f) raising the rotary cutting head relative to the cutting machine to disengage the asphalt road surface and terminate cutting of the asphalt road surface;

g) advancing the cutting machine to the next desired location of placement, the next desired location of placement being forward along the desired placement and immediately beyond the prior group of depressions formed by steps (d), (e) and (f);

h) pausing the cutting machine at the next desired location of placement;

i) continually repeating steps (d), (e), (f), (g) and (h) to form the desired placement of resulting depressions in the surface of the asphalt road until the desired placement of resulting depressions has been achieved.

8. The method defined in claim 7 wherein the predetermined size of each depression within each group of depressions is approximately seven inches wide, approximately sixteen inches length of base, approximately one half an inch deep and with a spacing between adjacent depressions of approximately five inches.

9. The method defined in claim 7 wherein the plurality of spaced cutting groups of the rotary cutting head comprise eight spaced cutting groups.

10. A depression cutting machine for cutting a group of relatively aligned indentations in an asphalt road surface during a cutting procedure, the resulting indentations each having a predetermined width, the width measured along the alignment of indentations, a predetermined length of base, the length of base measured relatively perpendicular to the edge of the asphalt surface, a predetermined depth, the depth measured from the plane formed by the prevailing surface of the asphalt road to the deepest point of the resulting indentation, the resulting indentations having a predetermined spacing between adjacent indentations, the depression cutting machine mountable to a self propelled vehicle, the self propelled vehicle comprising power take off means for supplying power to the depression cutting machine, the self propelled vehicle having directional control means to guide the depression cutting machine along a desired course, the self propelled vehicle having a forward direction of travel, measurement means for accurately measuring travel of the self propelled vehicle relative to a prior stationary position to a derived relative desired location, advancement means for causing movement of the self propelled vehicle along the forward direction of travel, pausing means for pausing the movement of the self propelled vehicle at a desired location, the depression cutting machine comprising;

a) a rotary cutting head contained within a cutting head assembly, the rotary cutting head having a predetermined length, the rotary cutting head movably attachable to the self propelled vehicle and in a manner providing orientation relatively aligned with the forward direction of travel of the self propelled vehicle, the rotary cutting head having a plurality of cutting bits in a predetermined spaced pattern forming a cutting diameter, the cutting bits forming a plurality of similarly dimensioned spaced cutting groups, the spaced cutting groups having perimeters, the perimeters being spaced one from another, the spaced cutting groups each having a length equal to the desired width of the resulting indentation, the spacing of the perimeters of each adjacent set of cutting sets being relatively equal to the desired spacing of the resulting indentations, the rotary cutting head deriving power from the power take off means of the self propelled vehicle, the rotary cutting head continually rotating during the cutting operation of the depression cutting machine;

b) height adjustment means for adjustment of the height of the rotary cutting head relatively perpendicular to the surface of the asphalt road, the height adjustment means being powered by the power take off means of the self propelled vehicle, the height adjustment means comprising a lowering action of the rotary cutting head to cause engagement of the surface of the asphalt road, and a raising action of the rotary cutting head to cause disengagement from the surface of the asphalt road during the cutting procedure;

c) lateral movement means for moving the rotary cutting head relatively perpendicular to the forward direction of travel and relatively parallel to the surface of the asphalt road during the cutting procedure, following the pausing of the advance of the self propelled vehicle, while the rotary cutting head continually engages the surface of the asphalt road, following engagement of the surface of the asphalt road utilizing the height adjustment means and prior to the disengagement of the surface of the asphalt road utilizing the height adjustment means, the lateral movement means being powered by the power take off means of the self propelled vehicle;

whereby the depression cutting machine would be attached to a self propelled vehicle and would perform, in repetition, a cutting procedure to install a predetermined desired placement of a series of SNAP type depressions.

11. The depression cutting machine defined in claim 10 wherein the power take off means of the self propelled vehicle comprise hydraulic power transfer.

12. The depression cutting machine defined in claim 10 wherein the predetermined width of the resulting indentation is approximately seven inches, the predetermined length of base of the resulting indentation is approximately sixteen inches, the predetermined depth of the resulting indentation is approximately one half an inch, the predetermined spacing between adjacent indentations is approximately five inches.

13. The depression cutting machine defined in claim 10 wherein the plurality of cutting sets of the rotary cutting head comprise eight cutting sets.

14. The depression cutting machine defined in claim 10 wherein the measuring means of the self propelled vehicle comprises a measuring wheel, having markings, attached to the self propelled vehicle.

* * * * *